United States Patent [19]

Ellsworth

[11] 3,969,551

[45] July 13, 1976

[54] CHEMICALLY SCULPTURING FABRICS

[75] Inventor: Robert E. Ellsworth, Wayne, N.J.

[73] Assignee: American Cyanamid Company, Stamford, Conn.

[22] Filed: July 5, 1974

[21] Appl. No.: 486,142

[52] U.S. Cl. ..... 427/282; 427/288; 427/381; 427/390; 427/394

[51] Int. Cl.[2] ..... B05D 5/00

[58] Field of Search ..... 117/37 R, 38, 104 R, 117/161 KP; 427/256, 282, 288, 379, 381, 390, 394, 428

[56] References Cited

UNITED STATES PATENTS

| | | | |
|---|---|---|---|
| 3,257,263 | 6/1966 | Miller | 161/119 |
| 3,352,741 | 11/1967 | Miller | 161/120 |
| 3,388,087 | 6/1968 | Dieterich | 260/29.2 |
| 3,412,054 | 11/1968 | Milligan et al. | 260/18 |
| 3,454,413 | 7/1969 | Miller | 117/5.5 |
| 3,507,729 | 4/1970 | Miller | 156/209 |
| 3,567,548 | 3/1971 | Miller | 156/277 |
| 3,640,924 | 2/1972 | Hermann et al. | 260/13 |
| 3,835,081 | 9/1974 | Remley | 260/29.2 TN |

*Primary Examiner*—Thomas J. Herbert, Jr.
*Assistant Examiner*—Bruce H. Hess
*Attorney, Agent, or Firm*—Robert J. Feltovic; H. G. Jackson

[57] ABSTRACT

The invention is a process for manufacturing a sculptured decorative finish on a textile fabric by applying an aqueous polyurethane latex in a pattern to the fabric and drying the fabric; and the sculptured fabric obtained by the process.

12 Claims, No Drawings

CHEMICALLY SCULPTURING FABRICS

FIELD OF THE INVENTION

The invention pertains to the use of polyurethane latex dispersions for sculpturing fabrics.

DESCRIPTION OF THE PRIOR ART

The prior art process for patterning textiles fabrics (U.S. Pat. Nos. 3,567,548; 3,507,729; 3,454,413; 3,352,741 and 3,257,263) disclose embossing procedures in which the patterning effect is created on the surface by chemical means. In chemical embossing the decoration is normally carried out with a solvent-based adhesive followed by drying the treated material. However, the application of decorative effects under these conditions is costly because of the necessity of recovering the solvent. In addition, pollution problems arise due to the use of an organic solvent in this process.

Although many of the patterning materials presently used employ a solvent base, aqueous base coatings are desirable since (1) they can be diluted with water for cleaning purposes, (2) they do not present a fire or explosion hazard, (3) they have less odor and are nontoxic and (4) they present no air pollution problems.

U.S. patent application Ser. No. 309,032 filed Nov. 24, 1972 discloses an aqueous urethane color printing system for floor coverings and other home furnishings. Other pertinent prior art references are U.S. Pat. No. 3,640,924, and copending commonly assigned U.S. patent applications Ser. No. 275,392 filed July 26, 1972, Ser. No. 275,393 filed July 26, 1972, and Ser. No. 322,334 filed Jan. 10, 1973.

U.S. Pat. Nos. 3,388,087 and 3,412,054 disclose aqueous emulsions of polyurethanes.

SUMMARY OF THE INVENTION

The invention is a process for manufacturing a sculptured decorative finish on a textile fabric which comprises applying a dispersion of an aqueous polyurethane latex composition having a viscosity from water thin to 300 cps or 15,000 to 90,000 cps to the fabric and drying the fabric containing the latex composition. The invention includes the sculptured fabric obtained by the described process.

DESCRIPTION OF PREFERRED EMBODIMENTS

I have discovered a simple, economical process which is useful for creating a permanent decorative effect on a textile substrate. This process involves printing the substrate with or without dispersion of a particulate colorant material in an aqueous polyurethane emulsion and subsequently drying the printed substrate to produce the decorative appearance. This process is useful for decorating such substrates as woven, tufted, knitted and foamed fabrics to impart a contoured sculptured appearance.

The aqueous compositions useful in the process of the invention are dispersions of a particular class of self-dispersible or emulsifiable polyurethane polymers. The polyurethane polymers are obtained by adding a particular class of isocyanate-terminated polyurethane prepolymers having pendant carboxyl groups to water containing a tertiary aliphatic amine and allowing chain extension with water to proceed until all of the isocyanate groups have been reacted. The resulting polyurethane latex is thickened to the desirable viscosity with a suitable thickening agent. These polymers are described in U.S. Pat. No. 3,640,924 and U.S. patent application Ser. Nos. 275,393 and 322,334. Colorant materials may be added if desired. The colorant materials which may be included in the compositions of this invention include a wide variety of both organic and inorganic colored or fluorescent pigments, alone or admixed with titanium dioxide.

The methods for preparing the dispersion or emulsion of the pigment in the polyurethane are conventional and any of the well-known procedures may be used. The usual method employed is to combine the urethane latex with a surfactant and a small amount of an aqueous dispersion of the pigment. The surfactant may be either ionic or nonionic in nature, however a nonionic surfactant is preferable.

The fundamental composition of this invention can be modified by incorporating therein various soluble or dispersible agents which further modify the surface or hand characteristic of the finished material, or which facilitate the application. For instance, the decorative compositions can contain (e.g., from 2 to 30% by weight of the total solids content) a surface modifying agent such as a blowing agent. Blowing agents which may be incorporated in the composition include azobisisobutyronitrile, N,N-dinitrosopentamethylene tetramine, azodicarbonamide, N,N-dimethyl-N,N-dinitrosoterephthalamide, ethylene carbonate, and the like.

A typical final latex composition useful in the invention comprises by weight between 20 and 50% of polyurethane solids, at least 1% total pigment solids, between about 0.2 and 0.5% solids of a surfactant, and between 5 and 20% solids of a surface-modifying agent depending on the end-product requirements.

The viscosity of the polyurethane latex composition can range from water thin to 300 cps and 15,000 to 90,000 cps. Suitable thickening agents such as methyl cellulose hydroxyethyl cellulose, polyacrylic acid emulsions plus alkali, and the like may be included to obtain the desired viscosity.

The application to the substrate is by conventional spraying, spluttering, gravure printing, screen printing and the like. For most purposes, a wet print layer of from 10 mils to 50 mils, preferably 20 mils to 35 mils in thickness is satisfactory, although greater or lesser thicknesses may be used if desired.

The printed textile substrate is then partially dried by heating from between 140° to 230°F until a surface skin forms on the urethane print paste, leaving the core of the urethane tacky. The substrate is then compressed by heated nip rolls and then cured from between 220° to 305°F for a period from 2 minutes to 6 minutes. The cured substrate then may be brushed or steamed to restore loft if required.

The process of the invention can be used with textile substrates comprising tufted, woven, nonwoven, knitted fabrics made of natural and synthetic fibers and mixtures thereof. Thus the process of this invention can be used to prepare decorative blankets, carpets, upholstery, drapery and apparel fabrics which consist of cellulosic fibers, such as cotton, acetate and rayon, and noncellulosic fibers, such as polyamides, polyesters and polyacrylics, and mixtures thereof, as well as with polyester and polyether foams.

The pigment dispersions of this invention are sufficiently viscous to prevent excessive penetration into the substrate. They form strong bonds with the substrate material and provide a finish which is flexible when dried and does not become brittle on aging. The finished effect is a contoured, decorative surface which has a multidimensional appearance.

The following examples illustrate the invention in more detail.

EXAMPLE 1

An acrylic upholstery fabric was silk screen printed with a composition comprising 15% by weight of ethylene carbonate and 85% by weight of a 30% solids thickened anionic polyurethane latex prepared by reacting toluene diisocyanate, propylene glycol having an average molecular weight of 1,000, and dimethylolpropionic acid. The viscosity of the composition as measured by a Brookfield (LVF) viscometer was 17,000 cps. The treated fabric was partially dried at 225°F for 1 minute in a pintenter and completely dried by pressing on a Hoffman press at 305°F at 40 pounds pressure for 1 minute and 15 seconds. The sample was then given a light brushing to bring up the nap. The treated fabric had a sculptured surface.

EXAMPLE 2

An acrylic fiber blanket was printed with the same composition and by the same procedure as described in Example 1. The product was a clearly defined multilevel patterned fabric that could be laundered without destroying the sculptured effects.

EXAMPLE 3

A rayon-faced upholstery fabric was printed with the same materials and by the same procedure as described in Example 1. The product had a sculptured surface.

EXAMPLE 4

A nylon-faced flocked drapery fabric was printed as in Example 1. The product had a clearly-defined sculptured surface.

EXAMPLE 5

An acrylic-faced tufted fabric was printed as in Example 1. The product was a clear, multilevel, sculptured surface.

EXAMPLE 6

A nylon knit fabric laminated to a foam backing was printed as in Example 1 except that no ethylene carbonate was used. The product had a sculptured design on the surface.

EXAMPLE 7

An acrylic flocked upholstery fabric was printed as in Example 1. The product had a sculptured design on the surface.

EXAMPLE 8

A tricot fabric was printed with a composition comprising 400 parts of a 30% solids thickened anionic polyurethane made from toluene diisocyanate, propylene glycol having an average molecular weight of 1,000, and dimethylol propionic acid, 20 parts of Calcotone Black NI Paste (C.I. 77266) and 4 parts of dinitrosopentamethylene tetramine as in Example 1 except that the fabric was dried at 275°F for 5 minutes. The viscosity of the composition as measured by a Brookfield (LVF) viscometer was 80,000 cps. The treated fabric had a sculptured appearance.

EXAMPLE 9

An acrylic carpet fabric was printed with a composition comprising a mixture of 25 parts of ethylene carbonate (85% real), 10 parts of Calcotone Scarlet YP Paste, 2 parts of 2,2,4,4,6-pentakis(methoxymethylamino)-6-hydroxymethylamino-s-triazine, 0.8 part of water, 0.2 part of a 30% aqueous solution of mixed isopropanolamine hydrochlorides and 62 parts of a 40% thickened anionic polyurethane latex (300–500 cps) prepared by reacting toluene diisocyanate, propylene glycol having an average molecular weight of about 1000, and dimethylol propionic acid, said printing composition having a viscosity of 50 cps as measured on a Brookfield Viscometer using No. 2 spindle at 60 RPM.

The acrylic carpet was printed by applying to the surface small drops of the printing composition with a pipette, pre-curing the treated carpet at 225° for 35 seconds, then heating the treated carpet on a New York Press at 300°F and 20 lbs. pressure for 45 seconds and finally over drying it at 275°F for 5 minutes. The treated fabric had a sculptured surface.

What is claimed:

1. A process for manufacturing a sculptured decorative finish on a textile fabric which comprises:

i. applying a dispersion of an aqueous polyurethane latex composition having a viscosity of from 15,000 to 90,000 cps obtained by adding an isocyanate-terminated polyurethane prepolymer having pendant carboxyl groups to water containing a tertiary aliphatic amine and allowing chain extension with water to proceed until all of the isocyanate groups have been reacted to the fabric by gravure rolls, flat screens or rotary screens in a pattern and ii. drying the fabric containing the latex composition at a temperature of 140° to 230°F. until internally tacky, iii. passing the fabric through a system of heated nip rolls, and iv. redrying the fabric at a temperature of 220° to 305°F. for 2 to 6 minutes.

2. A process according to claim 1 with the additional element of brushing the dried fabric to restore loft.

3. A process according to claim 1 with the additional element of steaming the dried fabric to restore loft.

4. A process according to claim 2 wherein the fabric is a pile fabric.

5. A process for manufacturing a sculptured decorative finish on a textile fabric which comprises:

i. applying a dispersion of an aqueous polyurethane latex composition having a viscosity from water thin to 300 cps obtained by adding an isocyanate-terminated polyurethane prepolymer having pendant carboxyl groups to water containing a tertiary aliphatic amine and allowing chain extension with water to proceed until all of the isocyanate groups have been reacted to the fabric by dripping the composition onto the fabric in a pattern;

ii. pre-drying the fabric containing the latex composition at a temperature of 140° to 230°F. for a period of about ½ minute to 5 minutes;

iii. heating at 220° to 305°F. pressure for a period of about ½ minute to 2 minutes;

iv. drying at a temperature of about 220° to 305°F. for a period of 2 to 6 minutes; and v. brushing the dried fabric to restore loft.

6. A process according to claim 5 wherein the dried fabric is steamed to restore loft.

7. A process according to claim 3 wherein the fabric is a pile fabric.

8. A sculptured fabric obtained according to the process of claim 1.

9. A sculptured fabric obtained according to the process of claim 2.

10. A sculptured pile fabric obtained according to the process of claim 3.

11. A sculptured pile fabric obtained according to the process of claim 4.

12. A sculptured pile fabric obtained according to the process of claim 7.

* * * * *